US006197112B1

(12) United States Patent
Stotz et al.

(10) Patent No.: US 6,197,112 B1
(45) **Date of Patent: *Mar. 6, 2001**

(54) SUPPORT BEAM IN A PAPER MACHINE

(75) Inventors: Wolf Gunter Stotz, Ravensburg; Christoph Link, Weingarten, both of (DE)

(73) Assignee: Voith Sulzer Papiermaschinen GmbH, Heidenheim (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/047,747

(22) Filed: Mar. 24, 1998

(30) Foreign Application Priority Data

Mar. 27, 1997 (DE) ..... 197 13 195

(51) Int. Cl.[7] ..... B05C 11/04

(52) U.S. Cl. ..... 118/100; 118/118; 118/123; 118/126; 118/413; 162/281; 15/256.5; 101/157; 101/169; 101/367

(58) Field of Search ..... 118/100, 118, 118/123, 126, 413; 427/356; 162/281; 15/256.5; 101/157, 169, 365

(56) References Cited

U.S. PATENT DOCUMENTS

| | | | | |
|---|---|---|---|---|
| 5,005,515 | * | 4/1991 | Sollinger | 118/100 |
| 5,269,846 | * | 12/1993 | Eskelinen et al. | 118/100 |
| 5,356,519 | | 10/1994 | Grabscheid et al. | 162/281 |

FOREIGN PATENT DOCUMENTS

| | | |
|---|---|---|
| 33 35 097 A1 | 4/1985 | (DE) . |
| 41 33 203 A1 | 4/1992 | (DE) . |
| 39 30 676 C2 | 8/1993 | (DE) . |
| 42 00 955 A1 | 8/1993 | (DE) . |
| 195 01 354C1 | 4/1996 | (DE) . |
| 296 00 016 U1 | 4/1996 | (DE) . |
| 195 45 413C1 | 2/1997 | (DE) . |
| 295 14 597 U1 | 2/1997 | (DE) . |

* cited by examiner

*Primary Examiner*—Laura Edwards
(74) *Attorney, Agent, or Firm*—Taylor & Aust, P.C.

(57) ABSTRACT

A support beam for at least one long working unit, notably of a paper machine or coater, includes several bundled, long profile elements forming in their entirety the support beam.

24 Claims, 4 Drawing Sheets

SUPPORT BEAM IN A PAPER MACHINE

BACKGROUND OF THE INVENTION

1. Field of the Invention

The present invention relates to a support beam for at least one extended working unit, notably of a paper machine or coater.

2. Description of the Related Art

A support beam for at least one extended working unit is generally known and employed customarily in conjunction with so-called paper machines or coaters. The German Patent Document No. DE 296 00 016, assigned to the assignee of the present invention, e.g., shows a support beam for a long applicator. The applicator rests on the support beam and is designed for direct or indirect application of a liquid or pasty coating medium onto a traveling material web, notably of paper, cardboard or textile material. The applicator can also be designed for final metering of a coating medium applied previously onto the material web. In the so-called direct application, the liquid or pasty coating medium is applied directly onto the surface of the traveling material web, which during application is carried on a revolving countersurface, e.g., an endless belt or a backing roll. In the indirect application of the medium, in contrast, the liquid or pasty coating medium is first applied onto a substrate surface, e.g., the surface of a backing roll configured as an applicator roll. From there, the coating medium is transferred from the applicator roll to the material web in a nip through which the material web passes.

Also known, from German Patent Document No. DE 41 41 133, assigned to the assignee of the present invention, is a support beam which together with a scraper blade forms a so-called scraper. The scraper is also intended for use in a machine for the manufacture or processing of fiber material webs, for example, paper webs. The scraper blade coacts directly with the shell surface of a rotating roll in order to keep the shell surface clean or to lift the paper web off of the shell surface.

In the known designs of the type described above, the support beam is manufactured as a single-piece component and has the shape of a long, hollow element. According to German Patent Document No. DE 41 41 133, e.g., the support beam is a long, hollow element which has a substantially polygonal cross section and is made of a fiber composite material. Instead of making the support beam of fiber composite material, there are also known designs wherein the support beam includes a different material (e.g., steel) and has a round cross-sectional shape.

A difficulty with these known designs, however, is that the support beam is manufactured as a single-piece component and, therefore, can only be configured for a specific load and adapted to particular conditions of use. A modification or reconfiguration of the single-piece support beam for adaptation to different operating conditions, e.g., a wider or narrower paper machine or coater, is normally beyond realization. Instead, the support beam always must be processed as a whole, which requires large and expensive machinery and is associated with high manufacturing costs. For example, employing a support beam in a wide or narrow paper machine or coater requires a dimensioning of the beam cross section in accordance with the loading that is applicable with the machine, for which purpose the cross section of the support beam is changed. Particularly in the manufacture of support beams from fiber composite material, however, a new tool must be made available and used for that purpose. This increases the manufacturing costs further. Special problems are involved particularly when a support beam assumes different temperatures on its front and back, perhaps from the process, e.g., developing heat which radiates from one direction. As a result, one side is heated to a higher temperature, expands, and thereby causes the entire beam to bend.

SUMMARY OF THE INVENTION

The present invention provides a support beam which allows easy and effective adaptation to different working conditions and loads and/or will not bend in the event of temperature differences.

The inventional support beam for at least one long working unit, notably of a paper machine or coater, includes several bundled, long profile elements which in their entirety form the support beam. The profile elements can be bundled such that they are in close point, line and/or surface contact on their outer peripheries along their longitudinal expanse. Possible, e.g., is an arrangement in which the profile elements are assembled such that they form in their entirety a support beam with a hollow cross section.

Understood as a working unit in the purport of the invention is any concept-specific apparatus, for example, suction boxes, headbox/slice nozzles, framing or framing parts, metering devices, open-jet applicators, applicators with an applicator chamber, leveling devices, scraper bars or finish metering apparatuses with one or several doctor elements and the like. The working unit is mounted with suitable fasteners on the support beam, the exact joining of working unit and support beam being discussed in more detail hereinafter.

Evolving from the bundled profile elements, as compared to known structures, is the great advantage that now a modular support beam concept is realizable. With this modular support beam concept, nearly any cross-sectional shapes and sizes for various support element types can be manufactured using individual standardized and easily reproducible components. This allows a high flexibility in the configuration of the support beam and allows easy and effective adaptation of the support beams to different operating conditions and loads. Beyond that, a very economical production is possible on account of the high degree of standardization achievable and the choice, in case of varying demands, of standard profile elements manufactured and stocked in great length and quantities.

According to one embodiment of the invention, the support beam includes at least two bundled, long profile elements. The bundling of three profile elements particularly results in a stable triangular shape in the support beam cross section. Basically, the inventional bundling of several profile elements to an assembly achieves a stabilization of the entire support beam profile and further reduces support beam flexure, as compared to known structures.

In another embodiment of the invention, the profile elements have a tubular cross-sectional shape. Using hollow elements instead of solid elements results in an especially lightweight support beam structure which possesses a very sound rigidity, even with relatively slight wall thicknesses of the profile elements. Also possible, in case of specific operating conditions and loads, is the use of solid cross-sectional shapes.

In yet another embodiment of the invention, the profile elements are either made of identical materials or different materials, which are combined within a component. As a result, support beam areas subject to high loads can be specifically reinforced with specific materials in order to counteract flexure. Thus, the solution according to the invention improves the bending and torsional resistance of the support beam. Such material combinations are normally not possible with the known technologies, since the known support beams of the type described above can be manufactured as single-piece components and the entire component is made of like material. The advantage of the present invention over known designs is that the designer is no longer limited in the selection of material.

According to a further embodiment of the invention, the profile elements are manufactured of at least one fiber composite material, since this material may display a neutral behavior in view of temperature and longitudinal expansion. A plastic reinforced with carbon fibers (CFK), e.g., has proved itself as fiber composite material. Here, the profile elements can be configured as single-piece components with the use of known manufacturing methods, such as filament winding or laying of prepreg matting, possibly with the application of heat and pressure. A suitable selection of the major fiber orientation and of the fiber content in the manufacture of the profile elements with fiber composite materials allows a thermal expansion approaching zero in the longitudinal direction of a profile element. Unfavorable flexure phenomena occurring with known support beams as the result of varying heating of different support beam areas are thereby easily minimized or even avoided. Furthermore, as compared with known material, such as steel, fiber composite material is more lightweight. For this reason, a flexure of the long support beam due to its inherent weight is reduced further. Overall, a very lightweight and bending-resistant structure is thereby created.

In this context, it has proved possible to manufacture the profile elements of materials with like or substantially like coefficients of thermal expansion. With given thermal conditions, a support beam deformation transverse to the longitudinal expanse, and specifically perpendicular to the working unit, can be avoided by a suitable arrangement of the various profile elements having different coefficients of thermal expansion. Basically, however, the individual profile elements may also be manufactured of materials with different coefficients of thermal expansion.

According to another embodiment of the invention, the profile elements are joined to one another directly or indirectly. To that end, adjacent profile elements that contact one another are joined to one another along mutually coordinated surfaces, lines or points of contact. In direct joining, adjacent profile elements are fixedly joined to one another, possibly by adhesive bonding or welding. This variant is particularly easy to realize in terms of engineering and results in a high overall rigidity of the support beam. Therefore, the use of relatively expensive flexure compensation systems is normally dispensable.

In a direct joining of the profile elements, moreover, bonding them to one another has been shown to be possible. This variant allows an easy and cost-effective manufacturing-related realization, especially with profile elements made of fiber composite material.

According to yet another embodiment variant, the profile elements are detachably joined to one another with the use of at least one adapter device. This allows easy separation for replacement with other profile elements of different materials, size or shape. Standardized adapter devices can be used for that, purpose. Modifications of the support beam can thereby be further simplified and most varying types of profile elements can be combined with one another.

According to a further embodiment of the invention, the profile elements have identical or different cross-sectional shapes and/or cross-sectional sizes. The combination of like and/or different cross-sectional shapes or sizes of the profile elements allows realizing the modular support beam concept. An individual support beam type can also be manufactured of different types of profile elements, so that the support beam can be easily and effectively modified and adapted to different requirements. In this context, it is possible to place at least one profile element in the center of the support beam and surround it with a plurality of profile elements. The profile element in the center of the support beam can possess a larger diameter than the profile elements bordering on it, so that a concentration of several elements in the center is avoided. Extending in the center along the longitudinal expanse of the support beam with no contribution to the rigidity of the support beam, the so-called neutral fiber is suitably bridged thereby.

In this context, profile elements with a substantially round or polygonal cross-sectional shape are possible. Depending on design particulars, however, a triangular or other suitable cross-sectional shape of the profile elements may be chosen. The round or polygonal shape offers the great advantage that the profile elements are substantially resistant to torsion. Very slight twisting or deformations occur in the peripheral direction of a profile element and in the peripheral direction of the entire support beam. Moreover, in the manufacture of profile elements from fiber composite material, this cross-sectional shape is particularly suited for the application of manufacturing methods known in the fiber composite material technology, e.g., the filament winding or prepreg mat laying mentioned above.

According to a still further embodiment of the invention, the profile elements include, in their longitudinal expanse, at least two individual elements in substantially axial succession. Here, the individual elements butt against one another with a fixed or detachable joint. For example, the individual elements may be fixedly joined to one another by bonding a plug or interior pipe in the hollow profiles of the individual elements at the respective joints. In this context it is possible to merely butt together the individual segments that are on the support beam side that is subject to load, this arrangement being particularly easy to realize. The individual segments can be fixedly joined on the traction side, so that in the areas of the support beam structure most heavily subjected to load, a high longitudinal strength can be achieved and guaranteed. Overall, this arrangement makes it possible to selectively vary the length of the profile elements and thereby adapt them to the length of the working unit being supported. Furthermore, using shorter components contributes to a simplification of the manufacturing process and of their handling or assembly. Shorter components also contribute to an easier stocking of profile elements.

Also possible is an embodiment in which the individual segments of adjacent profile elements are staggered relative to one another in their longitudinal expanse. The individual segments of the profile elements may be staggered in the length direction of the beam or again arranged with their butting ends in contact or joined together. The joints between individual segments of the profile elements which, when subjected to load, represent weak spots in terms of flexure, are thereby bridged and reinforced by parallel, continuous profile elements. This safeguards the rigidity of the support beam.

According to another embodiment of the invention, at least one profile element protrudes beyond each support beam end and forms a support beam mounting. The configuration of the latter may be such that, e.g., the profile element protruding beyond the length of the support beam is realized by insertion of a bolt or pipe into the hollow profile or by slipping a pipe on the outer periphery of the protruding profile element, thus guaranteeing a safe mounting. The profile element and pipe or bolt can be joined to one another by bonding, since this type of joint allows very easy and cost-effective realization. The reinforced profile elements protruding on the ends of the support beam make it possible, depending on the application, to either mount the support beam on the framing of a paper machine or coater, to mount it pivotably in a suitable mount, or to arrange it for translatory movement in a mounting.

In yet another embodiment variant of the invention, the support beam includes at least one mounting element for the working unit. The mounting element can again be subdivided in a plurality of individual mounting elements across the length of the support beam. Each individual mounting element, e.g., can have a length of maximally 200 millimeters. The mounting elements can be spaced so that different disturbing longitudinal expansions of the mounting elements due to the effects of temperature can be minimized. In this context, it is possible to form the mounting element of a fiber composite material, since that material provides a thermal shielding of the temperature-exposed working unit from the support beam. This allows a further reduction of the thermal expansion of the support beam in the longitudinal and/or transverse direction.

The mounting element may include joining surfaces and/or elements that are coordinated with the support beam and are made, for production-related reasons, as separate components. The separate components are subsequently joined to the working unit or at least one profile element of the support beam. According to a further embodiment of the invention, moreover, the working unit may also be directly attached to at least one profile element of the support beam. The working unit and the mounting element are assembled to the profile element in a longitudinally movable manner.

The inventional connection between the individual components of the apparatus makes it possible for the support beam to transmit holding forces to the working unit by way of the mounting element, thereby further counteracting a deformation of the working unit.

The working unit, the mounting element and the support beam may be joined to one another so as to be movable in a direction substantially parallel to their longitudinal expanse. This embodiment variant particularly suggests itself in conjunction with a linear guide and allows different longitudinal elongations between working unit, mounting element and support beam. Thus, the entire support beam structure is not subjected to flexure due to temperature effects. Proven as a linear guide between a mounting element and a working unit in this context, e.g., has been an arrangement in which the mounting element supports the working unit in a sliding guide, for instance a slide. This design allows an easier compensation for manufacturing tolerances as well as an easier adjustment of the working unit in machine cross direction and in relation to the support beam. This design also allows, when needed, moving the working unit during operation, for example, to manipulate the coating produced with the working unit.

For certain applications and material combinations it is possible to form the mounting elements and the profile elements of materials with identical or substantially identical coefficients of thermal expansion. This allows exerting a further positive influence on the flexure of these two components of the apparatus. However, due to the specific configuration of the inventional support beam described above, the mounting element and the profile elements may include materials with very different coefficients of thermal expansion without thereby causing a negative effect on the overall flexure behavior of these two components. The example mentioned here thus represents only a special case.

According to a still further embodiment feature, the support beam is provided with a thermal insulation or a shrouding on at least part of its outer periphery. The thermal insulation, e.g., may be an insulating layer which covers or surrounds the entire support beam or support beam section particularly exposed to temperature, thereby providing an additional thermal shielding. For instance, the thermal shielding prevents a heat transfer from the working unit to the support beam, and thus a deformation of the support beam itself that is caused by variations in the heating of different support beam areas. Moreover, the support beam may also feature a shrouding which serves, e.g., as a cover against environmental effects. For example, the shrouding can protect the support beam against dirt or liquids and prevent a penetration of the contaminations into the interior of the beam or between individual profile elements. In this context, the spaces between profile elements that are stacked in parallel may also be injected with foam and thereby sealed outwardly.

It is possible for at least one profile element to include at least two nested component profiles in order to provide an additional reinforcement of the profile element. The nested component profiles may be of the same or different cross-sectional shapes. For example, one component profile with a triangular cross section may be slipped into a component profile with a round cross section so that the inserted component profile rests on the inside of the outer component profile with point contact or line contact. At the points or lines of contact, the component profiles are either directly joined to one another, for example by bonding or welding, or indirectly fixed on one another, e.g., by use of links. Also possible is the nesting of component profiles with like cross-sectional shapes in such a way that a cavity is created between the inner and outer component profiles. Also, a joint between the nested component profiles may be created by injecting a lightweight bonding material (that is, e.g., a foam material or the like) into the space thus formed. This makes it possible to increase the rigidity of a profile element and to specifically manipulate its bending properties.

A fluid can be passed through the cavities of the profile elements or through the spaces formed between profile elements of parallel stacking. Thus, a temperature equalization is achieved throughout the support beam structure between support beam areas subject to different thermal stresses, and a beam flexure caused thereby is compensated for. The fluid pouring through the individual spaces is varied in its temperature, such that it thermally causes a compensation for flexure.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

To avoid repetitions, like assemblies and components are referenced identically in the following description and figures, provided there is no further differentiation required. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
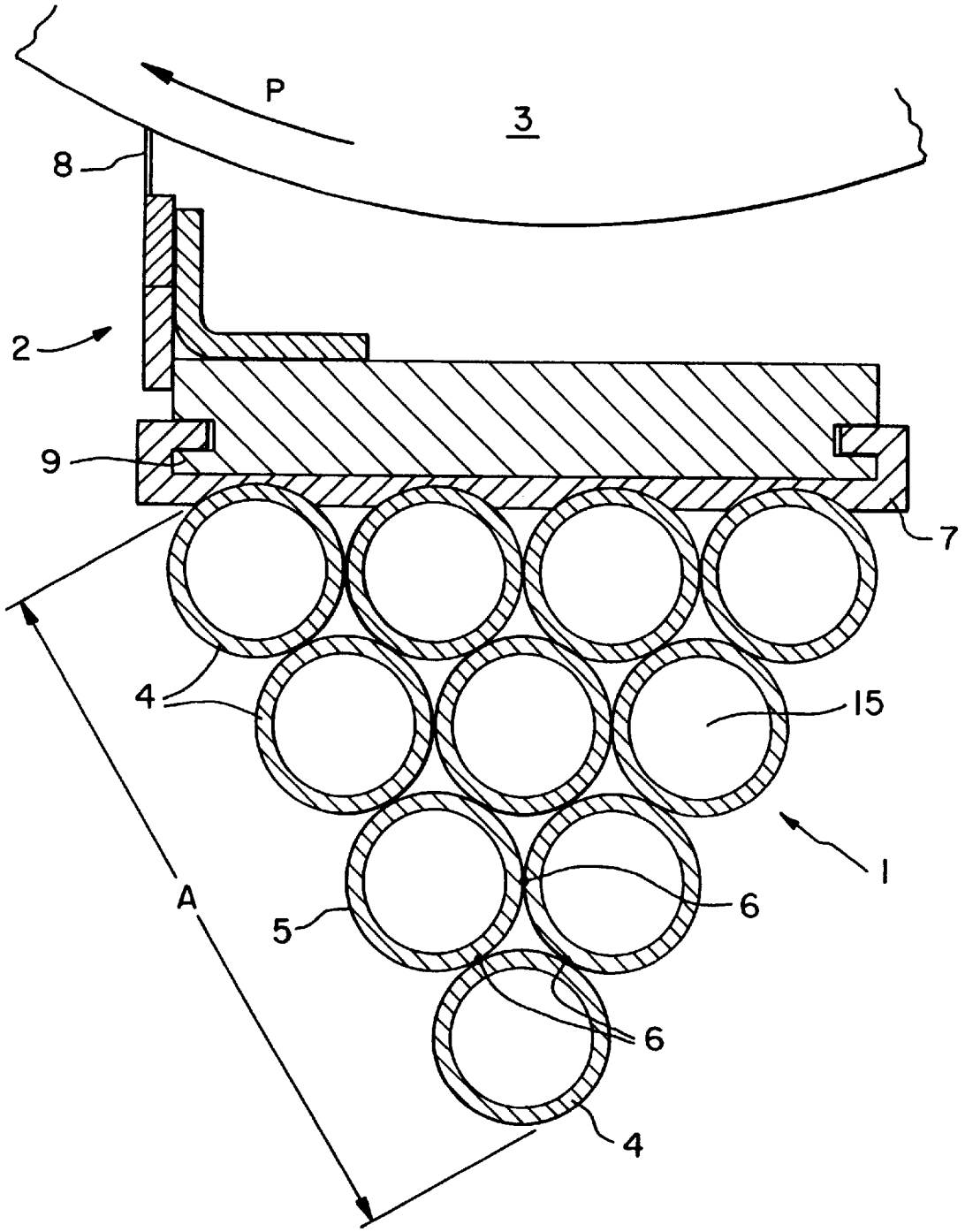
FIG. 1 is a schematic, cross-sectional view of one embodiment of the support beam of the present invention.

FIG. 1 shows a working unit 2 carried by an inventional support beam 1 and having the form of a metering device with a blade 8 which is in contact with the outer shell surface of a roll 3. The direction of rotation of roll 3 is indicated by an arrow P in the drawing.

As follows from FIG. 1, support beam 1 includes a plurality of bundled, long and thin-walled, tubular and the like profile elements 4. In the present case, each profile element 4 has a round, hollow cross-sectional shape 15 and is made of a fiber composite material 5. As further follows from the figure, adjacent profile elements 4 contact one another along their longitudinal expanse at lines of contact 6 and can be joined directly to one another, that is, bonded to one another.

The support beam 1 formed of profile elements 4 has a substantially triangular cross-sectional shape. In the embodiment shown in the figure, all three long sides of triangular support beam 1 have the same width A. Resulting from this cross-sectional shape of support beam 1 is an especially bending-resistant and torsion-resistant support beam structure. As needed, however, variation of the cross-sectional shape is possible. For example, the cross-sectional shape of support beam 1 may have shapes deviating from FIG. 1, such as round, oval, quadrangular or other polygonal shapes as well as mixed shapes thereof.

Arranged on the upper long side of support beam 1, i.e., on the long side nearest roll 3, is a mounting element 7 (subdivided in many individual sections, as the case may be) for working unit 2. According to FIG. 1, mounting element 7 is placed on the upper long side of support beam 1 and is bonded to the respective periphery of profile elements 4. Supporting working unit 2 and carrying it in a sliding guide 9, mounting element 7 can be manufactured of a material with a coefficient of thermal expansion differing from that of working unit 2. Moreover, working unit 2 is movable axially in relation to the longitudinal expanse of support beam 1 in sliding guide 9, which can be configured as a slide.

Figure 2:
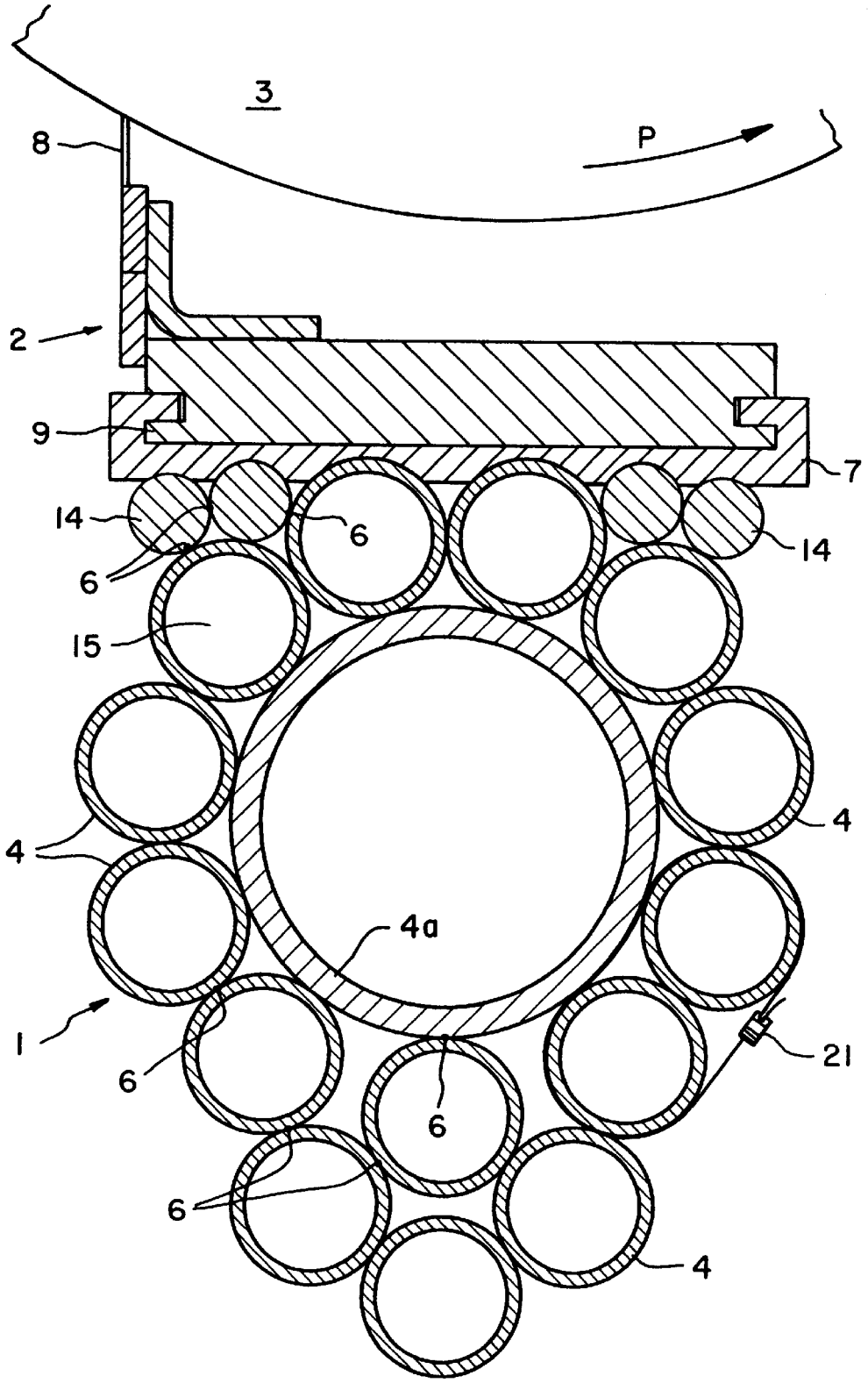
FIG. 2 is a schematic, cross-sectional view of a second embodiment of the support beam of the present invention.

FIG. 2 shows a schematic cross-sectional view of the inventional support beam according to a second embodiment. As indicated by arrow P, the direction of rotation of roll 3 in this drawing is opposite to the direction of rotation relative to FIG. 1, for which reason blade 8 of working unit 2 works as a scraper.

As can be seen from FIG. 2, support beam 1 again includes a plurality of bundled, long profile elements 4, but which are, in this case, dissimilar. Profile elements 4 have both solid cross sections 14 and hollow cross sections 15. As follows further from FIG. 2, profile elements 4 also differ in cross-sectional size. For example, a plurality of profile elements 4 of smaller diameter are arranged on the upper long side of support beam 1, i.e., on the long side nearest roll 3, while a profile element 4*a* of larger cross section is contained in the center of support beam 1. The overall result is thus a structure in which a profile element 4*a* with larger diameter is disposed in the center of support beam 1, which then is surrounded by a plurality of profile elements 4 with smaller diameters. The profile elements 4 with smaller diameters are partly arranged in a multilayer stacking. This is the case on the bottom side of the beam, since here is located a support beam zone which is subject to higher stresses and, therefore, the beam structure is reinforced further by the stacked profile elements 4. Profile elements 4 can be detachably joined by adapter devices 21, one of which is illustrated in the form of a band-type clamp. Adapter devices can also be in the form of plug-in connectors, with adjacent profile elements 4 having respective male and female connectors.

FIG. 2 also illustrates, analogous to the embodiment in FIG. 1, mounting element 7 for working unit 2. Mounting element 7 is arranged on the upper long side of support beam 1 and is attached to the relevant periphery of profile elements 4. The guidance of working unit 2 in mounting element 7 takes place according to the variant in FIG. 1.

Figure 3:
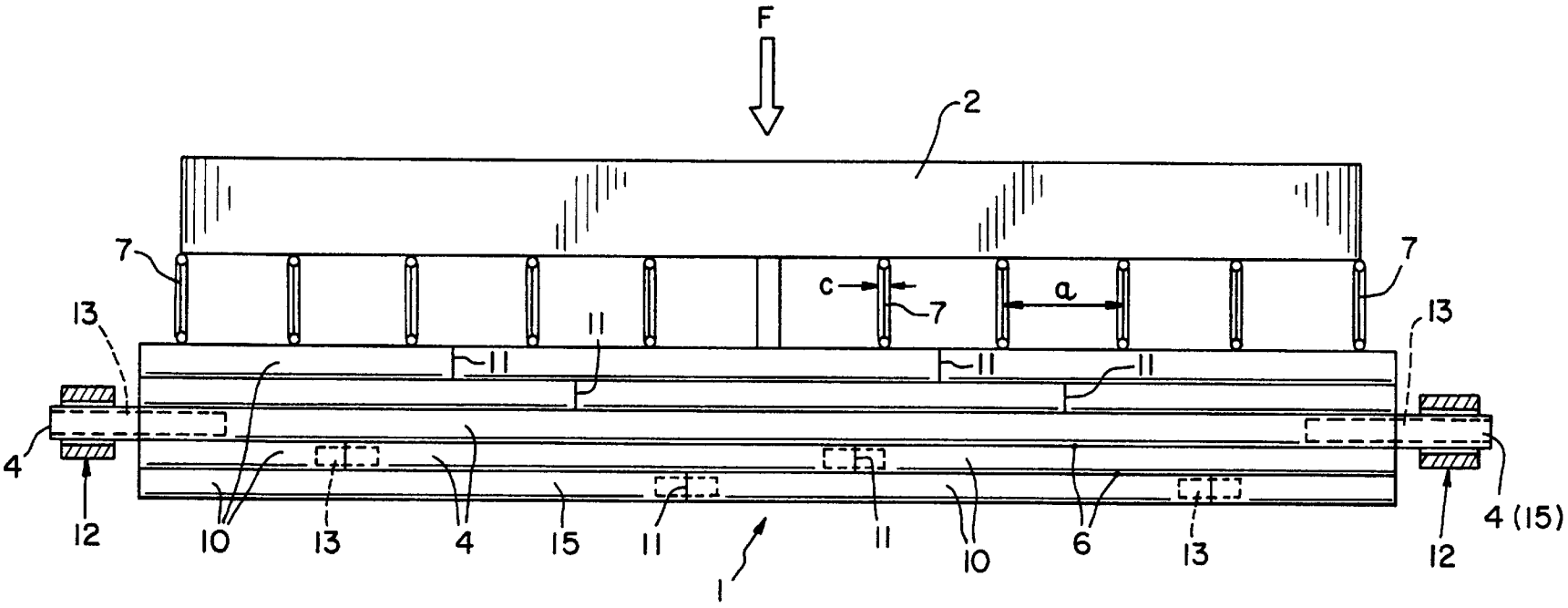
FIG. 3 is a schematic, longitudinal-section view of a third embodiment of the support beam of the present invention.

FIG. 3 depicts schematically a lengthwise sectional view of the inventional support beam according to a third embodiment. As can be seen, profile elements 4 are along their longitudinal expanse composed of several individual segments 10 and are subjected to load in a direction indicated by arrow F. On the top side of the beam subject to load, the individual segments 10 are merely butted end-to-end at points 11. However, on the bottom side, which is subject to traction, they are fixed to one another at their butting ends 11 by bolts 13 which are bonded into hollow cross-sectional profiles 15.

From FIG. 3 it follows, furthermore, that support beam 1 possesses on its ends a profile element 4 which protrudes beyond the length of support beam 1 and forms together with an external bearing element a support beam mounting 12. Support beam 1 is movable in translatory manner and/or pivotable in support beam mounting 12. To that end, in order to reinforce the profile elements, a bolt 13 is inserted in profile elements 4 which are configured as hollow profiles 15 on the two ends of support beam 1. Thus, a mounting is available that is sufficiently dimensioned for the weight of the support beam 1 to be carried, including the coordinated working unit 2.

Arranged on the top length side of support beam 1 is working unit 2. It is joined to support beam 1 by way of a plurality of side-by-side and mutually spaced mounting elements 7, which compensate for any displacements or distortions between working unit 2 and support beam 1 caused by temperature differences. The compensation is effected by compensating movements in the longitudinal and/or transverse direction of beam 1. Mounting elements 7 may consist of many individual segments. The clearances a are larger than the width c of an individual element 7.

Figure 4:
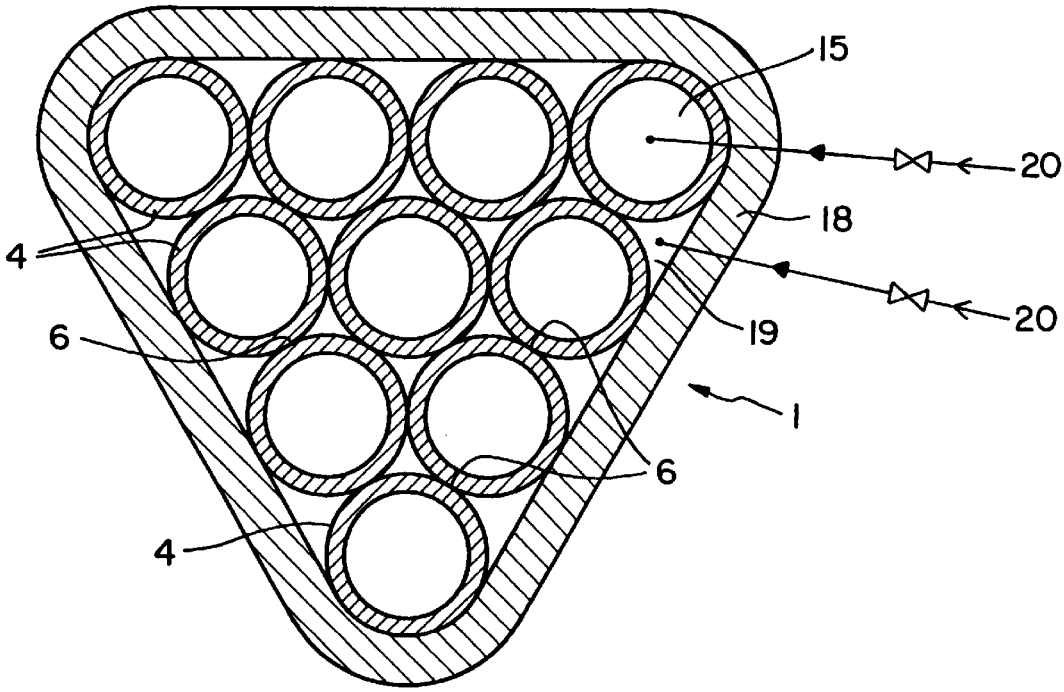
FIG. 4 is a schematic, cross-sectional view of a fourth embodiment of the support beam of the present invention.

FIG. 4 shows a fourth embodiment of a support beam 1 which, analogous to FIG. 1, is composed of a plurality of bundled, long and thin-walled, tubular and the like profile elements 4 and has a substantially triangular cross-sectional shape. Support beam 1 is on its outer periphery entirely enclosed by a shroud 18 which is in contact with support beam 1 and profile elements 4. Achieved thereby is a thermal insulation.

From FIG. 4 it also follows that a temperature-modifying fluid 20 may be passed through cavities 15 of profile elements 4*a* or 10 and/or spaces 19 formed between adjacent profile elements 4. Accomplished thereby is a temperature equalization between support beam areas subject to different thermal stresses. Thus, a flexure of beam 1 is compensated for or prevented.

Figure 5:
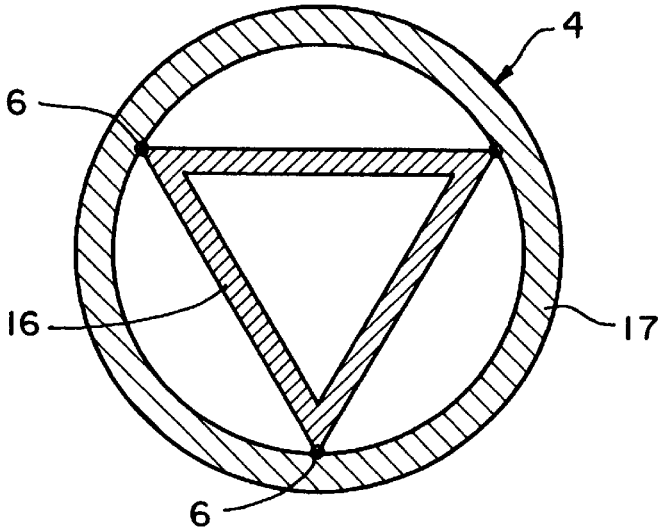
FIG. 5 is a schematic, cross-sectional view of a profile element of a fifth embodiment of the support beam of the present invention.

FIG. 5 depicts a special profile element 4 of a support beam 1 according to a fifth embodiment. Profile element 4 includes two nested component profiles 16, 17, each having a different, hollow cross-sectional shape. Possessing a triangular hollow cross-sectional shape, inner profile 16 rests at lines of contact 6 along its longitudinal expanse on the inside periphery of outer component profile 17, which has a round cross-sectional shape. Inner component profile 16 and outer component profile 17 are joined to one another along lines of contact 6.

The invention is not limited to the above embodiments, which merely serve the general explanation of the basic idea of the invention. Instead, the inventional support beam may, within the scope of protection, also assume forms of embodiment other than described above. The support beam may possess features which represent a combination of the relevant individual features of the claims. Furthermore, the profile elements forming the support beam may be of other designs, such as those adapted to the geometries of the working unit and the support beam. Also, materials other than fiber composite material may be used for the profile elements. Moreover, the support beam may be equipped with flexure-compensating devices known as such. A flexure-compensating device of this type may be one whose engineering is based on a thermal, pneumatic, hydraulic, magnetic, inductive or mechanical principle of equalization.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In one of a paper machine and coater, an apparatus comprising:

a support beam including a plurality of elongate profile elements, each said profile element being rigid and resistant to at least one of torsion and bending, said profile elements being bundled together, said bundling of said profile elements thereby minimizing flexure of said support beam; and at least one elongate working unit carried by said support beam.

2. The apparatus of claim 1, wherein said plurality of profile elements includes at least two bundled profile elements.

3. The apparatus of claim 1, wherein each said profile element has a hollow cross-sectional shape.

4. The apparatus of claim 1, wherein each said profile element is formed of a same kind of material.

5. The apparatus of claim 1, wherein each said profile element is formed of at least two different materials.

6. The apparatus of claim 5, wherein said plurality of profile elements are formed of at least one fiber composite material.

7. The apparatus of claim 5, wherein said plurality of profile elements are formed of at least two materials having substantially equal coefficients of thermal expansion.

8. The apparatus of claim 1, wherein said plurality of profile elements are directly joined to one another.

9. The apparatus of claim 8, wherein said plurality of profile elements are bonded to one another.

10. The apparatus of claim 1, wherein said plurality of profile elements are indirectly joined to one another.

11. The apparatus of claim 10, said apparatus further comprising at least one adapter device, each said adapter device detachably joining at least two of said plurality of profile elements together.

12. The apparatus of claim 1, wherein each said profile element has a same cross-sectional shape.

13. The apparatus of claim 12, wherein said same cross-sectional shape is one of substantially round and substantially polygonal.

14. The apparatus of claim 1, wherein said plurality of profile elements have different cross-sectional shapes.

15. The apparatus of claim 1, wherein each said profile element has a same cross-sectional size.

16. The apparatus of claim 1, wherein said plurality of profile elements have different cross-sectional sizes.

17. The apparatus of claim 1, wherein each said profile element has a longitudinal direction and is comprised of at least two individual segments, said individual segments being successively axially disposed in said longitudinal direction of said profile element.

18. The apparatus of claim 17, wherein said segments of adjacent said profile elements are staggered relative to one another in said longitudinal direction of said profile element.

19. The apparatus of claim 1, wherein each said profile element has two opposite ends, said opposite ends of one said profile element extending past said opposite ends of other said profile elements, said opposite ends of said one profile element forming support beam mountings.

20. The apparatus of claim 1, wherein said support beam includes at least one mounting element carrying said working unit, said at least one mounting element being carried by said plurality of profile elements.

21. The apparatus of claim 1, wherein said support beam includes an outer periphery and one of thermal insulation and shrouding, said one of thermal insulation and shrouding surrounding at least a portion of said outer periphery.

22. The apparatus of claim 1, wherein at least one said profile element surrounds another said profile element.

23. The apparatus of claim 1, wherein said support beam has a longitudinal direction and a substantially zero thermal expansion in said longitudinal direction.

24. The apparatus of claim 1, wherein at least one said profile element has a hollow cross section, adjacent said profile elements defining spaces therebetween, said support beam being configured to receive a temperature-modifying fluid within at least one of said hollow cross sections and said spaces.

* * * * *